United States Patent [19]

MacLeod

[11] 4,219,104

[45] Aug. 26, 1980

[54] WHEELCHAIR LIFT DEVICE

[75] Inventor: Brian H. MacLeod, Oxford, Mich.

[73] Assignee: General Motors Corporation, Detroit, Mich.

[21] Appl. No.: 948,101

[22] Filed: Oct. 3, 1978

[51] Int. Cl.[2] ..... B66B 9/20

[52] U.S. Cl. ..... 187/9 R; 280/166; 296/62

[58] Field of Search ..... 187/9 R, 9 E, 10; 280/166; 105/443, 447, 448; 182/88; 296/55, 56, 62; 414/540, 541, 556

[56] References Cited

U.S. PATENT DOCUMENTS

| | | | |
|---|---|---|---|
| 1,071,129 | 8/1913 | Anderson et al. | 105/447 |
| 3,095,216 | 6/1963 | Browne et al. | 280/166 |
| 3,833,240 | 9/1974 | Weiler | 280/166 |
| 3,853,369 | 12/1974 | Holden | 280/166 |
| 4,020,920 | 5/1977 | Abbott | 182/19 |

*Primary Examiner*—Kenneth W. Noland
*Attorney, Agent, or Firm*—Edward J. Biskup

[57] ABSTRACT

A wheelchair lift device including a platform located in the stepwell of a motorcoach for raising and lowering a wheelchair between a first position wherein the platform is in horizontal alignment with an elevated floor formed with the motorcoach and a second position wherein the platform is at ground level. The device includes foldable hinged sections that are positioned through a linkage to form steps for use by able-bodied persons and are extendible relative to the stepwell so as to align the hinged sections along a horizontal plane and thereby form the platform for supporting the wheelchair. In addition, a ramp is carried by one of the sections for movement from a stored position to an aligned position with the hinged sections for facilitating movement to and from the platform and to a restraining position for preventing the wheelchair from rolling off the platform.

3 Claims, 5 Drawing Figures

WHEELCHAIR LIFT DEVICE

This invention concerns elevator devices in general and more particularly a wheelchair lift device that incorporates a movable ramp for facilitating wheelchair movement to and from the platform portion of the lift device.

U.S. Pat. No. 4,124,097 entitled "Wheelchair Lift Device," which issued on Nov. 7, 1978 in the names of Dale A. Hawks, Daniel L. Kline and James T. Hogan and assigned to the assignee of this invention, discloses a wheelchair lift device that includes a pair of substantially vertically oriented guide bars secured to the body of the vehicle on the opposite sides of a doorway that opens into a stepwell that leads into the interior of the vehicle. A carriage is mounted on each of the guide bars for movement from a raised position to a lowered position, and a pair of links connect the carriage with a platform assembly which includes a plurality of hinged sections that normally form a stairway having treads and risers when the carriage is in the raised position. One of the links consists of a power-operated linearly extensible and contractible member while the other link is a rigid member with one end pivotally connected to the carriage and the other end connected to one of the hinged sections. The arrangement of the links and the hinged sections is such that when the power-operated link member is contracted, the hinged sections move outwardly relative to the doorway and cause the platform assembly to be formed into a horizontal support located in the plane of the vehicle floor. After the platform assembly is deployed in line with the vehicle floor, the carriage then is moved from the raised position to the lowered position so as to place the wheelchair support at ground level.

This invention concerns a wheelchair lift device of the type described above that incorporates a ramp carried by one of the hinged sections for facilitating movement of the wheelchair to and from the horizontal support. A mechanism, including a pair of links of unequal length, is connected to the ramp for controlling movement of the latter from a first position wherein the ramp is stored beneath the aforesaid hinged section to a second position within the ramp is located in substantial horizontal alignment with the horizontal support to facilitate movement of the wheelchair thereto and therefrom and to a third position wherein the ramp is disposed in a plane substantially normal to the plane of the hinged section so as to prevent the wheelchair from rolling off the horizontal support. In addition, power-operated extensible means is connected to one of the links for moving the ramp from the first position to the second and third positions.

The objects of the present invention are to provide a new and improved wheelchair lift device for a motor vehicle having a plurality of hinged sections that can be converted from a step arrangement to a horizontal platform for supporting a wheelchair with one of the hinged sections having a ramp that is movable from a stored position to an aligned position with the platform and also to a wheelchair restraining position above the platform; to provide a new and improved wheelchair elevator that includes a plurality of hinged angularly related members which are movable to alternately form steps or a horizontal platform for supporting a wheelchair and are combined with a ramp supported by a pair of links of unequal length for facilitating wheelchair movement to and from the wheelchair lift device and for preventing the wheelchair from rolling off the lift device when the hinged sections are formed into the platform; and to provide a new and improved wheelchair lift device for the stepwell of a bus that is provided with a ramp supported by a pair of link members located along intersecting axes and which control movement of the ramp from a stored position to a platform aligned position and to a wheelchair restraining position.

Other objects and advantages of the present invention will be more apparent from the following detailed description when taken with the drawings in which.

Figure 1:
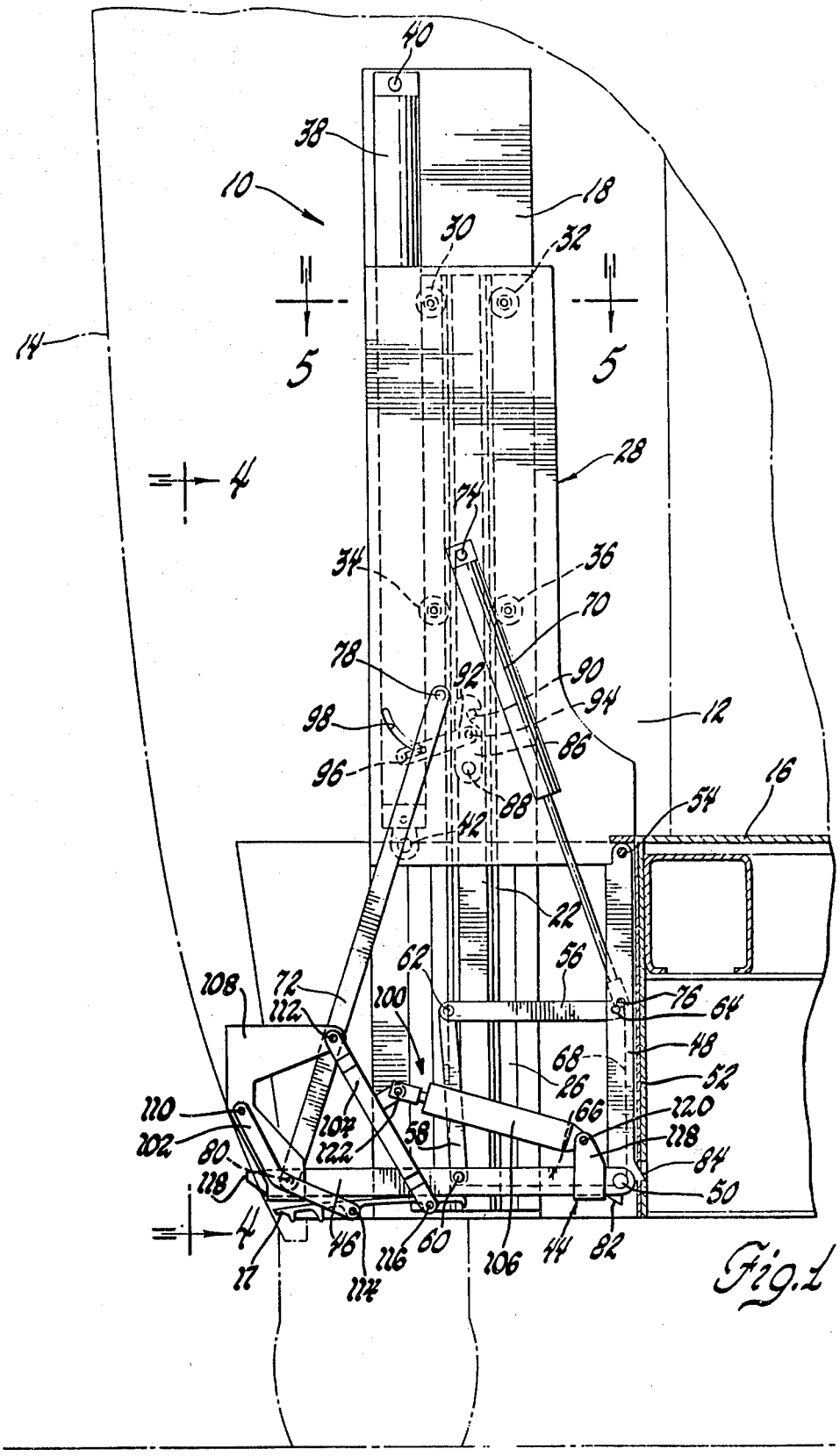
FIG. 1 is an elevational view showing a wheelchair lift device equipped with a movable ramp in accordance with the invention and incorporated in the stepwell of a motor vehicle.
Figure 4:
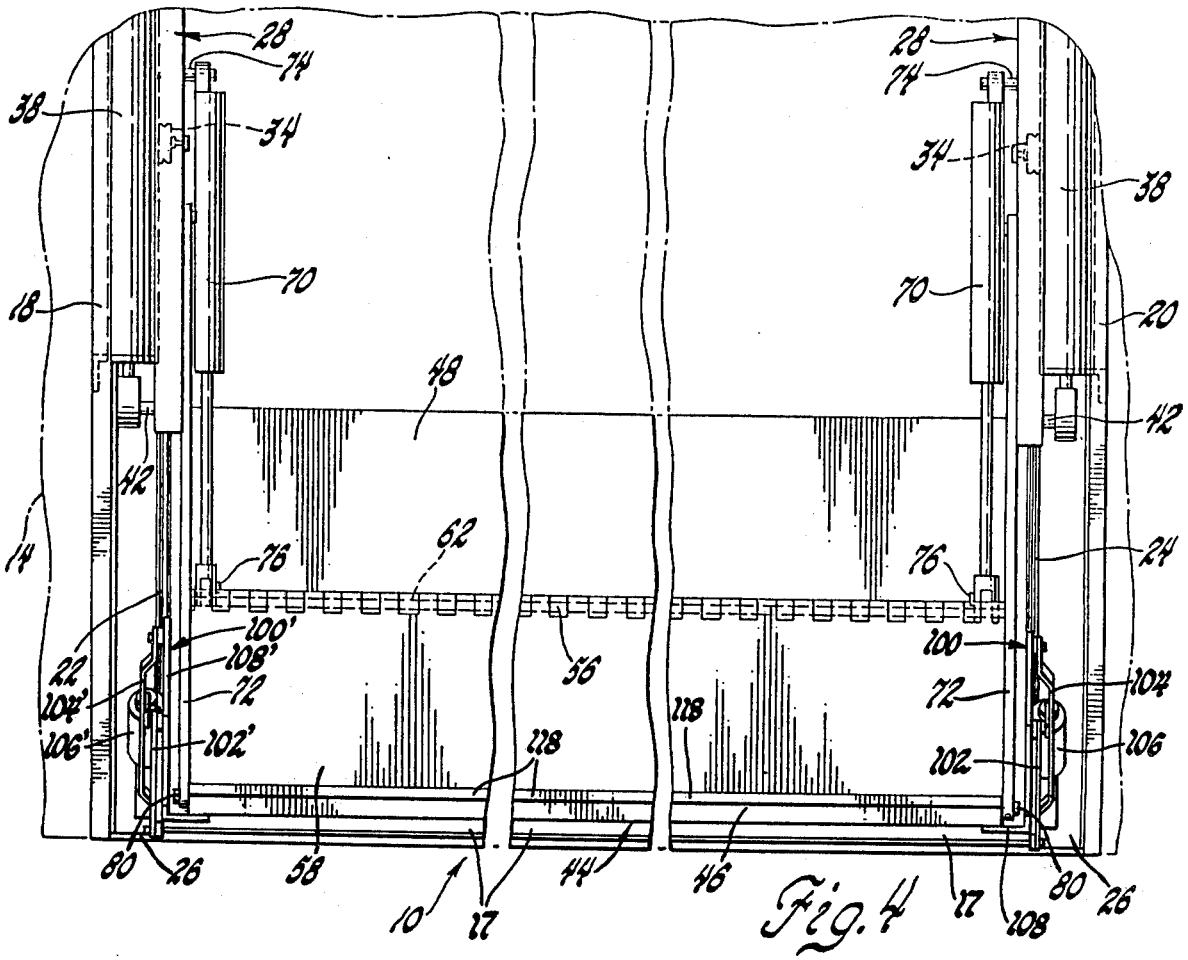
FIG. 4 is a view taken on lines 4—4 of FIG. 1.
Figure 5:
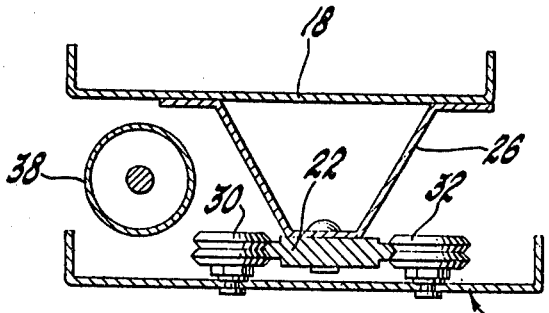
FIG. 5 is an enlarged sectional view taken on lines 5—5 of FIG. 1.

Referring to the drawings and more particularly FIGS. 1, 4, and 5 thereof, a wheelchair lift device 10 is shown positioned within the stepwell 12 of a motor vehicle 14 such as a coach or bus of the type used in mass public transit having the usual floor 16 which is at an elevation above ground level. As will be more apparent as the description of the invention proceeds, the wheelchair lift device 10 provides the usual two steps in the stepwell 12 of the vehicle permitting normal entry and exit for able-bodied passengers. In addition, the steps of the wheelchair lift device 10 can be converted through a suitably arranged linkage into a horizontal support for a wheelchair that can be moved between an aligned position with the vehicle floor 16 and a ground level position while at the same time a ramp 17 is selectively positioned for restraining movement of the wheelchair and for facilitating movement to and from the wheelchair lift device as will hereinafter be described. In this manner, a physically handicapped person confined to a wheelchair can be served by the vehicle 14.

More specifically, the wheelchair lift device 10 comprises a pair of frame members 18 and 20 spaced along an axis parallel to the longitudinal axis of the vehicle 14 and located in the stepwell 12 of the vehicle 14. The frame members 18 and 20 are secured in vertical positions to the associated frame structure of the vehicle 14 and respectively rigidly support vertically disposed guide bars 22 and 24 each of which is secured to the associated frame member through a generally "V" shaped bracket 26 as seen in FIG. 5. Each of the guide bars 22 and 24 has the side edges thereof shaped in the form of a "V" when viewed in cross section in FIG. 5, and is adapted to support a carriage 28. In this connection, it will be noted that each carriage 28 includes an upper pair of horizontally aligned rollers 30 and 32 and a lower pair of horizontally aligned rollers 34 and 36 which engage and ride along the associated guide bar. A double-acting hydraulic cylinder 38 is mounted to each of the frame members 18 and 20 and is connected to the carriage 28 for moving the latter between the positions shown in FIG. 1 and that shown in FIG. 3. The hydraulic cylinders 38 are identical in size and each includes a cylinder member and a relatively movable piston member. As seen in FIG. 1, the cylinder member has its base end connected to the associated frame member by a pivot connection 40 while the rod end of the piston member is connected to the carriage 28 by a pivotal connection 42. Accordingly, when pressurized fluid is directed to the base ends of the hydraulic cylinders 38 while the piston end thereof is vented, the piston rods are moved vertically downwardly resulting in the carriages 28 being moved from the position of FIG. 1 to that shown in FIG. 3. This movement causes a platform 44, after it is deployed, to be moved as a unit from an elevated position to a ground level position as will be explained hereinafter.

It will be noted that the aforementioned steps of the wheelchair lift device 10 form a part of the platform 44 which is located in the stepwell 12. The platform 44 consists of a plurality of hinged sections that extend between the guide bars 22 and 24 as seen in FIG. 4. As seen in FIG. 1, the platform 44 comprises a pair of planar front and rear base sections 46 and 48 which are pivotally interconnected at their inner ends by a pivotal connection 50 for movement about a horizontal axis that is substantially parallel to the longitudinal axis of the vehicle. As seen in FIG. 1, the platform 44 is shown in the collapsed or folded position wherein it is disposed adjacent to a vertical back wall 52 formed rigidly with the body of the vehicle 14. In the collapsed position, the rear base section 48 is located in a vertical plane adjacent back wall 52 and has its upper end connected by pivotal connection 54 to the carriage 28, while the front base section 46 is located in a horizontal plane. The base sections 46 and 48 support a tread member 56 and a riser member 58 which are sections of the platform that also extend between the guide bars 22 and 24 as seen in FIG. 4. The riser member 58 has one end connected by a pivotal connection 60 to the front base section 46 intermediate the ends thereof. The other end of the riser member 58 is connected to one end of the tread member 56 by a piano hinge that provides a pivotal connection 62 as seen in FIG. 1. The other end of the tread member 56 is connected to the rear base section 48 by a pivotal connection 64 intermediate the ends of the rear base section 48. The front base section 46, between pivotal connections 60 and 50, and the rear base section 48, between pivotal connections 50 and 64, are respectively formed with wells 66 and 68 having a depth and longitudinal length corresponding to the width and longitudinal length of the associated tread and riser members 56 and 58 so as to allow storage of the latter when the platform 44 is deployed to the extended or unfolded position shown in FIGS. 2 and 3.

Figure 2:
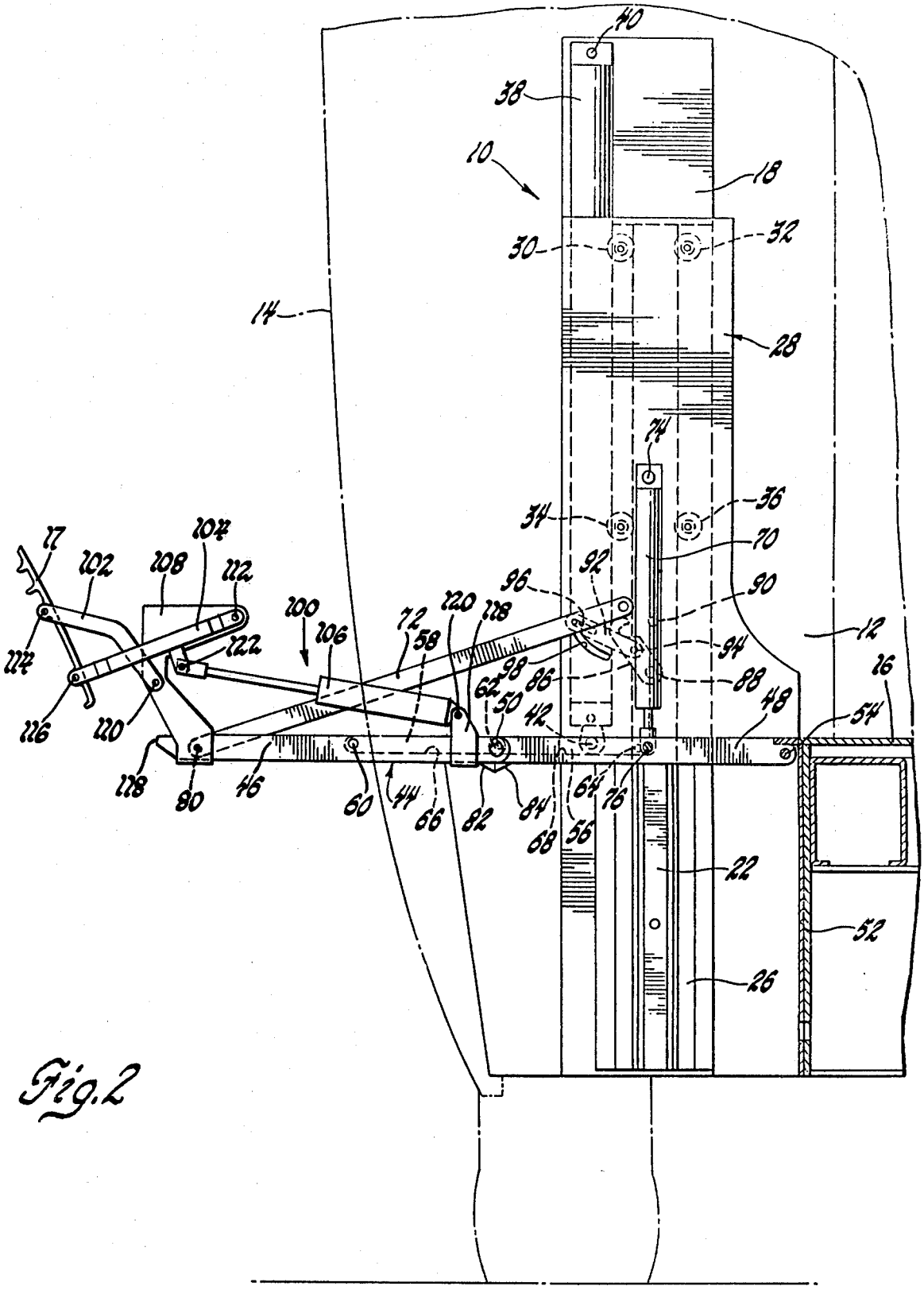
FIG. 2 is a view similar to FIG. 1 with the platform of the wheelchair lift device being deployed in line with the floor of the motor vehicle and the ramp positioned for restraining a wheelchair.
Figure 3:
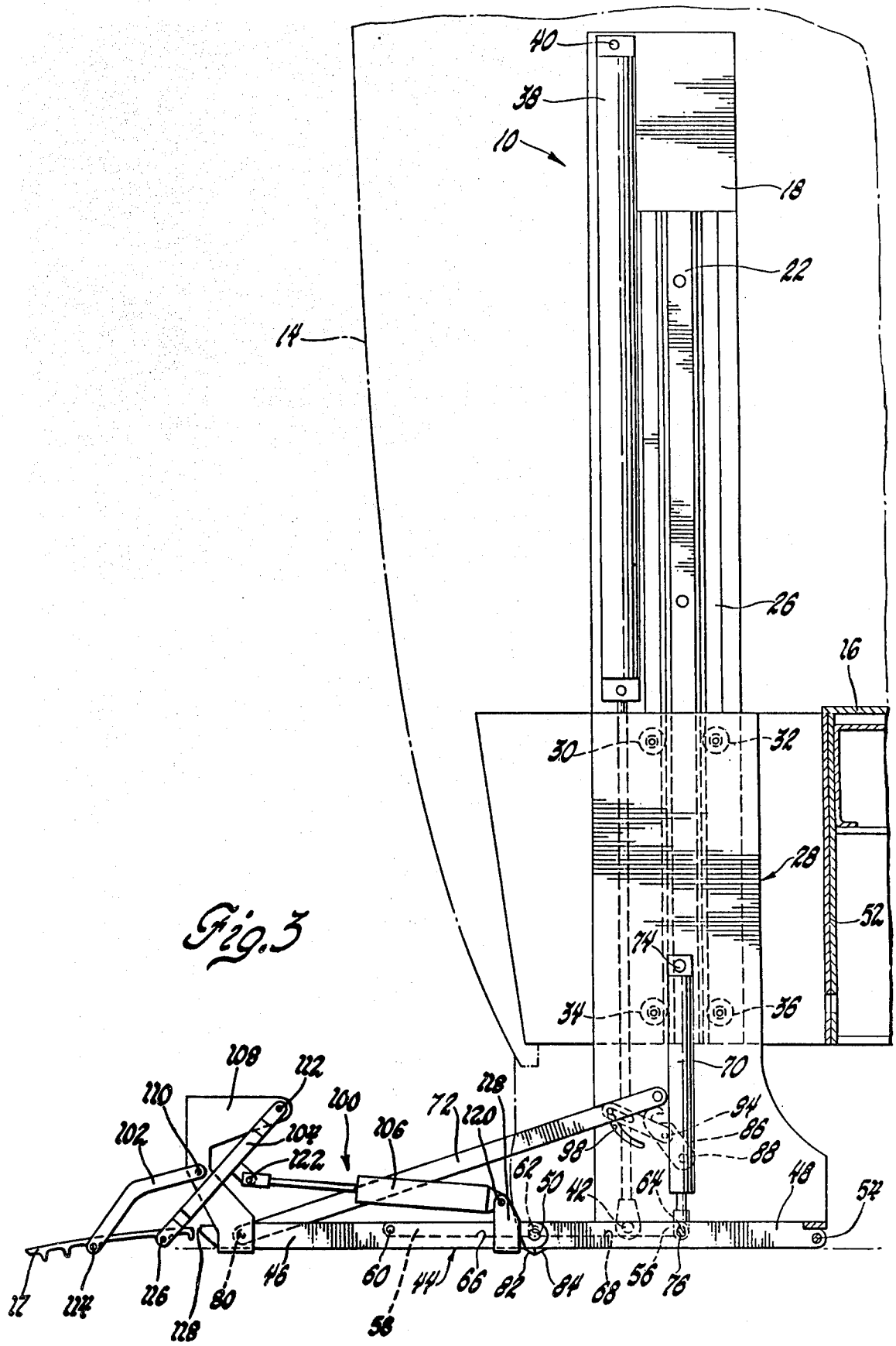
FIG. 3 is a view of the wheelchair lift device similar to that shown in FIGS. 1 and 2 with the platform being positioned at ground level and with the ramp aligned with the platform.

The deployment of the platform 44 to the unfolded positions of FIGS. 2 and 3 is realized through a two-link supporting linkage arrangement incorporated with each of the carriages 28. The linkage arrangement includes a double-acting hydraulic cylinder 70 that serves as an extensible and contractible link member. In addition, a rigid link member 72 is provided and together with the hydraulic cylinder 70 is carried by the carriage 28. The hydraulic cylinder 70 consists of a cylinder member and a relatively reciprocating piston member with the base portion of the cylinder member being connected to the carriage 28 by a pivotal connection 74. The piston member of the hydraulic cylinder 70 is connected to the base section 48 intermediate the ends thereof by a pivotal connection 76. The rigid link member 72 has one end thereof pivotally connected to the carriage 28 by a pivotal connection 78 while the other end is connected to the outboard end of the base section 46 by a pivotal connection 80.

From the above description, it should be apparent that when the wheelchair lift device 10 has the parts thereof located in the normal position as seen in FIG. 1, the tread and riser members 56 and 58 are disposed in substantially mutually perpendicular planes so as to form the riser and tread portions of a one step while the outer end of the front base section 46 forms the tread portion of a second step. Thus, an able-bodied person can gain entrance into the vehicle 14 by first stepping on the outer end of the base section 46 and then on the tread member 56 and finally on the floor 16 of the vehicle. If, however, a physically handicapped person in a wheelchair should wish to gain entrance into the vehicle 14, the vehicle operator would actuate a control valve of a suitable hydraulic control system (not shown) that would direct pressurized fluid to the piston rod end of the hydraulic cylinder 70 while venting the base end of the cylinder member. This would cause contraction of the hydraulic cylinder 70 by having the piston rod thereof drawn into the cylinder member with resultant pivoting of the base section 48 in a clockwise direction about the pivotal connection 54. As the rear base section 48 rotates in this manner, it carries the front base section 46 upwardly and outwardly relative to the stepwell 12 about the same pivotal connection 54 under the control of the link member 72 which is pivoted in a clockwise direction about pivotal connection 78. This movement of the link members 70 and 72 continues until the base sections 46 and 48 are horizontally aligned with the floor 16 of the vehicle as seen in FIG. 2. In order to assure proper alignment, stop tabs 82 and 84 can be provided on the base sections 46 and 48 respectively adjacent the pivotal connection 50. At this point, the platform 44 is fully deployed to form a horizontal support surface for the wheelchair.

It will be noted that as the platform 44 moves from the folded or collapsed position of FIG. 1 to the deployed position of FIG. 2, the tread and riser members 56 and 58 move into the associated wells 66 and 68 formed in the base sections 46 and 48 so as to provide a substantially level, flat support surface. After the platform 44 is in the position of FIG. 2, the operator, through the appropriate movement of the aforementioned control valve, will cause the base end of the hydraulic cylinder 38 to be pressurized while the piston rod end thereof is vented. As a result, the piston rod of the hydraulic cylinder 38 moves out of the associated cylinder member and causes the associated carriage 28 to move downwardly along its guide bar and at the same time lowers the platform 44 from the elevated position of FIG. 2 to the ground level position of FIG. 3. The wheelchair can then be rolled onto the platform 44 and locked into position. The vehicle operator then reverses the procedure, causing the piston rod end of the hydraulic cylinder 38 to receive pressurized fluid and the base end thereof to be vented so that contraction of the cylinder 38 occurs, resulting in the carriage 28 and the platform 44 to be returned to the FIG. 2 position wherein the platform 44 is once again horizontally aligned with the floor 16. The wheelchair is then rolled onto the floor 16 after which pressurized fluid is directed to the base end of the hydraulic cylinder 70 causing the base section 48 to be rotated in a counter-clockwise direction about the pivotal connection 54 so as to return the various parts of the platform 44 to the folded position of FIG. 1 wherein the steps are formed for normal usage of the vehicle entrance.

In order to eliminate the possibility of an over-center action that could prevent the tread and riser members 56 and 58 from properly returning to the step forming position of FIG. 1 after they are located in the aligned position of FIG. 2, the tread and riser members 56 and 58 can be sized so that the center of the piano hinge or pivotal connection 62 is slightly above a horizontal plane passing through the centers of pivotal connections 60 and 64 when the platform 44 is in the FIG. 2 position. Another manner of accomplishing the same result would be to incorporate a spring at the pivotal connection 62 which would continuously bias the tread and riser members 56 and 58 towards the step forming position of FIG. 1.

The wheelchair lift device 10 described above utilizes a lock lever 86 that serves to lock the carriage 28 to the associated guide bar when the carriage 28 is in the raised position and the platform 44 is in the folded position of FIG. 1. As seen in FIG. 1, the lock lever 86 is connected at one end to the carriage 28 by a pivotal connection 88 while the other end of the lock lever 86 is formed as a hook that cooperates with a pin 90 fixed with the associated guide bar for locking the carriage 28 in the raised position. The lock lever 86 is automatically released from its engaged or locked position with the pin 90 during the deployment of the platform 44 from the position of FIG. 1 to that shown in FIG. 2. The unlocking action of the lock lever 86 occurs automatically when the link member 72 rotates clockwise about the pivotal connection 78 as seen in FIG. 1. In this connection, it will be noted that a link 92 connects the lock lever 86 to the link member 72 through a pivotal connection 94 and a pin and slot connection 96 with the slot being formed in the link 92 and the pin being fixed with the link member 72. A curved slot 98 formed in the carriage 28 accommodates the pin as the link member 72 rotates from the FIG. 1 position to the FIG. 2 position about pivotal connection 78.

As hereinbefore alluded to, the ramp 17 serves to restrain movement of a wheelchair when the platform 44 is in the deployed position of FIG. 2 and also serves to facilitate movement of the wheelchair to and from the wheelchair lift device when the platform 44 is in the lowered position of FIG. 3. In order to move the ramp 17 between the restraining position of FIG. 2 and the aligned position of FIG. 3, an operating mechanism 100 is provided which includes a pair of links 102 and 104 and an air-operated double-acting cylinder 106. As seen in FIG. 1, the upper ends of the links 102 and 104 are pivotally supported on a bracket 108 by pivot connections 110 and 112, respectively. The bracket 108 is fixed to the side portion of the front base section 46, and the lower ends of the links 102 and 104 are pivotally connected to the ramp 17 by pivot connections 114 and 116, respectively. Thus, the links 102 and 104 support the ramp 17 and control movement thereof as the latter is moved from the stored position shown in FIG. 1, wherein the ramp 17 is located beneath the front base section 46, to a restraining position shown in FIG. 2 wherein the ramp 17 is positioned forwardly of the front edge 118 of front base section 46 and is located along a plane which is inclined approximately 60° relative to the plane of the aligned front and rear base sections 46 and 48. In the latter position, the wheelchair, while on the support platform, is restrained by the inclined ramp 17 so that it cannot roll off the support platform. The ramp 17 is also capable of being located in a substantially aligned position with the base sections 46 and 48 as shown in FIG. 3 so as to facilitate movement of the wheelchair onto or off of the support platform 44 when the latter is at ground level.

As should be apparent from the above, the positioning of the ramp 17 from the stored position of FIG. 1 to the restraining position of FIG. 2 and to the aligned position of FIG. 3 is realized through the expansion and contraction of the cylinder 106 which has its base end connected to a bracket 118 by a pivot connection 120. The bracket 118 is fixed to the front base section 46 adjacent pivotal connection 50. The rod end of the cylinder 106 is connected by a pivot connection 122 to link 104 substantially midway between the ends thereof.

Although not shown, the cylinder 106 is provided with ports at the head end and the base end thereof through which pressurized air is selectively supplied to and exhausted from the opposite ends of the cylinder so as to expand and contract cylinder 106 as needed in order to obtain the desired movement of the ramp 17 at appropriate times. In this connection, a control system can be provided which will automatically connect the opposite ends of cylinder 106 with a source of pressurized air so that appropriate positioning of the ramp 17 is realized when the support platform 44 is moved from the step forming position of FIG. 1 to the positions shown in FIGS. 2 and 3. Also, it will be noted that the links 102 and 104 are of different length, link 104 being longer than link 102. Moreover, the pivot connection 110 is at a lower level than pivot connection 112.

The arrangement of pivot connections and link lengths as described above and as seen in FIGS. 1–3 and were found to provide optimum positioning of the ramp 17 as it is moved from the stored position to the restraining position and to the aligned position. In this connection, one linkage arrangement which has been found to provide the desired positioning of the ramp 17 had a link 104 which measured 130 mm along a straight line from the center of pivot connection 112 to the center of pivot connection 116. The link 102 measured 98 mm along a straight line from the center of pivot connection 110 to the center of pivot connection 114. Also, the distance between the centers of pivot connections 114 and 116 measured 51 mm while the distance from the centers of pivot connections 110 and 112 measured 72 mm. In addition, the center of pivot connection 110 was spaced from a horizontal plane passing through the center of pivot connection 112 by a distance equal to 46 mm when measured along a line perpendicular to the horizontal plane.

Finally, it will be noted that, as seen in FIG. 4, the opposite side of the front base section 46 is provided with an identical linkage arrangement and an air operated cylinder 106' which operates in unison with the cylinder 106 for moving the ramp 17 between the aforementioned positions.

Various changes and modifications can be made in this construction without departing from the spirit of the invention. Such changes and modifications are contemplated by the inventors and they do not wish to be limited except by the scope of the appended claims.

The embodiments of the invention in which an exclusive property or privilege is claimed are defined as follows:

1. In combination with a wheelchair lift device having front and rear hinged sections that are foldable through a support linkage to form steps located entirely within the stepwell of a vehicle for use by able-bodied persons and are extendible relative to the stepwell so as to align the hinged sections along a horizontal plane to form a platform for supporting the wheelchair, means connected to said hinged sections for moving the latter vertically when formed as a platform so the wheelchair may leave and enter the vehicle, a ramp carried by said front section for facilitating movement of the wheelchair to and from said front and rear sections when the latter are formed into said platform and are located at ground level, a mechanism including a pair of non-parallel links pivotally connected to said ramp and to said front section for controlling orbital movement of the latter about said front section from a first position wherein said ramp is stored beneath and adjacent to said front section to a second position wherein said ramp is located in substantial horizontal alignment with said front section to facilitate said movement of the wheelchair to and from the platform and to a third position wherein the ramp is disposed forwardly of and at an elevation above the front section and in a plane that is inclined relative to the plane of said front section so as to prevent the wheelchair from rolling off the platform, and power-operated means connected to one of said links for moving said ramp from said first position to said second and third positions.

2. In combination with a wheelchair lift device having front and rear hinged sections that are foldable through a support linkage to form steps located entirely within the stepwell of a vehicle for use by able-bodied persons and are extendible relative to the stepwell so as to align the hinged sections along a horizontal plane to form a platform for supporting the wheelchair, means connected to said hinged sections for moving the latter vertically when formed as a platform so the wheelchair may leave and enter the vehicle, a ramp carried by said front section for facilitating movement of the wheelchair to and from said front and rear sections when the latter are formed into said platform and are located at ground level, a mechanism carried by said front section and including a pair of links pivotally connected to said ramp for controlling orbital movement of the latter about said front section from a first position wherein said ramp is stored beneath and adjacent to said front section to a second position wherein said ramp is located in substantial horizontal alignment with said front section to facilitate said movement of the wheelchair to and from the platform and to a third position wherein the ramp is disposed forwardly of and at an elevation above the front section and in a plane that is inclined relative to the plane of said front section so as to prevent the wheelchair from rolling off the platform, and a power-operated cylinder pivotally connected at one end to said front section and having the other end pivotally connected to one of said links for moving said ramp from said first position to said second and third positions.

3. In combination with a wheelchair lift device having front and rear hinged sections that are foldable through a support linkage to form steps within the stepwell of a vehicle for use by able-bodied persons and are extendible relative to the stepwell so as to align the hinged sections along a horizontal plane to form a platform for supporting the wheelchair, a ramp carried by said front section for facilitating movement of the wheelchair to and from said front and rear sections when the latter are formed into said platform, a mechanism carried by the front section for controlling orbital movement of the ramp about said front section from a first position wherein said ramp is stored beneath said front section to a second position wherein said ramp is located in substantial horizontal alignment with said front section to facilitate said movement of the wheelchair to and from the platform and to a third position wherein the ramp is disposed forwardly of the front section and in a plane that is inclined relative to the plane of said front section so as to prevent the wheelchair from rolling off the platform, said mechanism including a bracket rigid with said front section, first and second links respectively supported at one end on said bracket by first and second pivot connections, the other end of said first and second links being respectively connected to said ramp by third and fourth pivot connections, the arrangement of said pivot connections being such that a straight line extending through the centers of said first and third pivot connections and a straight line extending through the centers of said second and fourth pivot connections intersect at a point below said front section when the ramp is in said stored position and intersect at a point above said front section when the ramp is in the aligned and restraining positions, and power-operated extensible means supported at one end by the front section and at the other end connected to one of said links for moving said ramp from said first position to said second and third positions.

* * * * *